US005865412A

United States Patent [19]

Mason

[11] Patent Number: 5,865,412

[45] Date of Patent: Feb. 2, 1999

[54] BEVERAGE CONTAINER HOLDER

[75] Inventor: Paul R. Mason, Richmond Hill, Canada

[73] Assignee: Post Primitive Technology, Inc., Toronto, Canada

[21] Appl. No.: 824,770

[22] Filed: Mar. 26, 1997

[51] Int. Cl.[6] ..... A47K 1/08

[52] U.S. Cl. ..... 248/311.2; 248/214; 248/231.81; 248/300; 297/188.18

[58] Field of Search ..... 248/311.2, 228.7, 248/231.81, 214, 300; 297/188.14, 188.18

[56] References Cited

U.S. PATENT DOCUMENTS

| | | | |
|---|---|---|---|
| 2,617,473 | 11/1952 | Krimstock et al. | 297/188.18 X |
| 2,950,836 | 8/1960 | Murdock . | |
| 2,960,601 | 11/1960 | Higgins | 248/311.2 X |
| 3,036,717 | 5/1962 | Johnson | 248/311.2 X |
| 3,586,368 | 6/1971 | Guild . | |
| 3,945,596 | 3/1976 | Marraccini . | |
| 4,063,701 | 12/1977 | Wray . | |
| 4,560,128 | 12/1985 | Willeby et al. . | |
| 4,728,147 | 3/1988 | Dutton | 297/188.18 |
| 4,799,638 | 1/1989 | Allen . | |
| 4,844,400 | 7/1989 | Jasmagy, Jr. | 248/311.2 |
| 4,948,197 | 8/1990 | Sansing | 297/188.14 X |
| 5,007,612 | 4/1991 | Manfre . | |
| 5,106,046 | 4/1992 | Rowles et al. | 248/311.2 |
| 5,143,337 | 9/1992 | Tomayko, Jr. et al. | 248/311.2 |
| 5,199,678 | 4/1993 | Luebke . | |
| 5,257,765 | 11/1993 | Halle | 248/311.2 X |
| 5,295,650 | 3/1994 | Brandt . | |
| 5,326,064 | 7/1994 | Sapien | 248/311.2 |
| 5,356,107 | 10/1994 | Sinohuiz . | |
| 5,395,085 | 3/1995 | Mann . | |
| 5,397,089 | 3/1995 | Kataoka | 248/311.2 |
| 5,584,453 | 12/1996 | Morter | 248/311.2 X |

FOREIGN PATENT DOCUMENTS

| | | |
|---|---|---|
| 2226954 | 11/1974 | France . |

*Primary Examiner*—Derek J. Berger
*Attorney, Agent, or Firm*—Connolly & Hutz

[57] ABSTRACT

A beverage container holder to be removably attached to an armrest of a chair includes an arm member and a receptacle on one end of the arm member to receive and support a beverage container in a stable manner. A flexible, generally U-shaped retainer is on the opposite end of the arm member and is configured to engage the armrest to secure the beverage container holder to the armrest. The receptacle includes a base, at least one upright wall extending generally about the periphery of the base and a slot provided in the upright wall. The slot extends downwardly from an upper rim of the upright wall to the base and also extends partially across the base.

17 Claims, 10 Drawing Sheets

BEVERAGE CONTAINER HOLDER

FIELD OF THE INVENTION

The present invention relates in general to beverage container holders and more particularly to a beverage container holder removably attachable to the armrest of a chair.

BACKGROUND OF THE INVENTION

Beverage container holders for both beer and pop cans which are attachable to the armrest of a chair are well known in the art. Examples of such beverage container holders are shown in U.S. Pat. No. 4,063,701 to Wray, U.S. Pat. No. 4,560,128 to Willeby et al, U.S. Pat. No. 5,295,650 to Brandt and U.S. Pat. No. 5,356,107 to Sinohuiz.

Unfortunately, these prior art beverage container holders are complex in construction and are not easily and quickly attachable to the chair. In addition, these prior art beverage container holders only allow certain types of beverage containers such as flat bottomed cans, cups and glasses to be supported in a stable manner. Beverage containers having stems or handles either cannot be supported at all or can only be supported in an unstable manner.

U.S. Pat. No. 5,199,678 to Luebke discloses a beverage cup holder having an arm to overlie the armrest of a chair. A small flange is at one end of the arm and bears against the inside edge of the chair armrest. At the other end of the arm is a depending flange extending to a cup holding ring. Hook and loop fabric is provided on top of the arm and a binding strap is secured to the undersurface of the arm. The binding strap encircles the armrest and engages the hook and loop fabric on the top of the arm to secure the beverage cup holder to the armrest. Although the Luebke beverage cup holder provides for a simple means of attaching the beverage cup holder to the armrest, only beverage containers in the form of cups can be supported. Accordingly, versatile beverage container holders which can be quickly and easily attached to the armrest of a chair are desired.

It is therefore an object of the present invention to provide a novel beverage container holder.

SUMMARY OF THE INVENTION

According to one aspect of the present invention there is provided a beverage container holder to be removably attached to an armrest of a chair, said armrest having a generally vertical inner sidewall and a generally horizontal top extending from said sidewall, said holder comprising:

an arm member;

a receptacle on one end of said arm member to receive and support a beverage container; and a flexible retainer on an opposite end of said arm member to accommodate said sidewall with said arm member overlying an upper surface of said top.

In a preferred embodiment, the flexible retainer is generally U-shaped and includes a pair of arms joined by a bight, one of the arms depending from one end of the arm member and the other of the arms having a free distal end positioned below and spaced from an undersurface of the top. Preferably, the free distal end is outwardly flared and is spaced from the undersurface of the arm member so as to contact the undersurface of the top when the beverage container holder is attached to the armrest.

It is also preferred that the arm member has at least one longitudinally extending supporting rib thereon. In one embodiment, the arm member has a pair of longitudinally extending supporting ribs on its upper surface with the ribs being integrally formed with and running adjacent opposed side edges of the arm member.

Preferably, the receptacle includes a base and at least one upright wall extending generally about the periphery of the base. It is also preferred that a slot is formed in the receptacle and extends downwardly through the upright wall from an upper rim thereof. In a preferred embodiment, the slot extends downwardly through the upright wall to the base and also extends partially across the base. Preferably, the receptacle further includes an annular support surface therein spaced from the base with the annular support surface lying in a plane generally parallel to the base.

According to another aspect of the present invention there is provided a beverage container holder to be removably attached to a support comprising:

an arm member;

a connector to connect said arm member to said support; and a receptacle adjacent one end of said arm member to receive and support a beverage container, said receptacle including a base; at least one upright wall extending generally about the periphery of said base; and a slot provided in said upright wall and extending downwardly from an upper rim thereof.

Preferably, the slot extends downwardly through the upright wall to the base. It is also preferred that the slot extends partially across the base and terminates generally at the center thereof.

The present invention provides advantages in that the flexible retainer allows the beverage container holder to be quickly and easily attached to and removed from the armrest of a chair. The receptacle configuration allows virtually all types of beverage containers to be supported in a stable manner. The base and annular support surface of the receptacle provide support surfaces for beverage containers of different diameters. The slot which extends downwardly through the upright wall and partially across the base of the receptacle allows the stem or handle of a beverage container to pass so that these types of beverage containers may be received by and supported stabily in the receptacle. The present invention also provides advantages in that the beverage container holder is of a simple design making it inexpensive and easy to manufacture.

BRIEF DESCRIPTION OF THE DRAWINGS

Embodiments of the present invention will now be described more fully with reference to the accompanying drawings in which.

DETAILED DESCRIPTION OF THE PREFERRED EMBODIMENT

Figure 1:
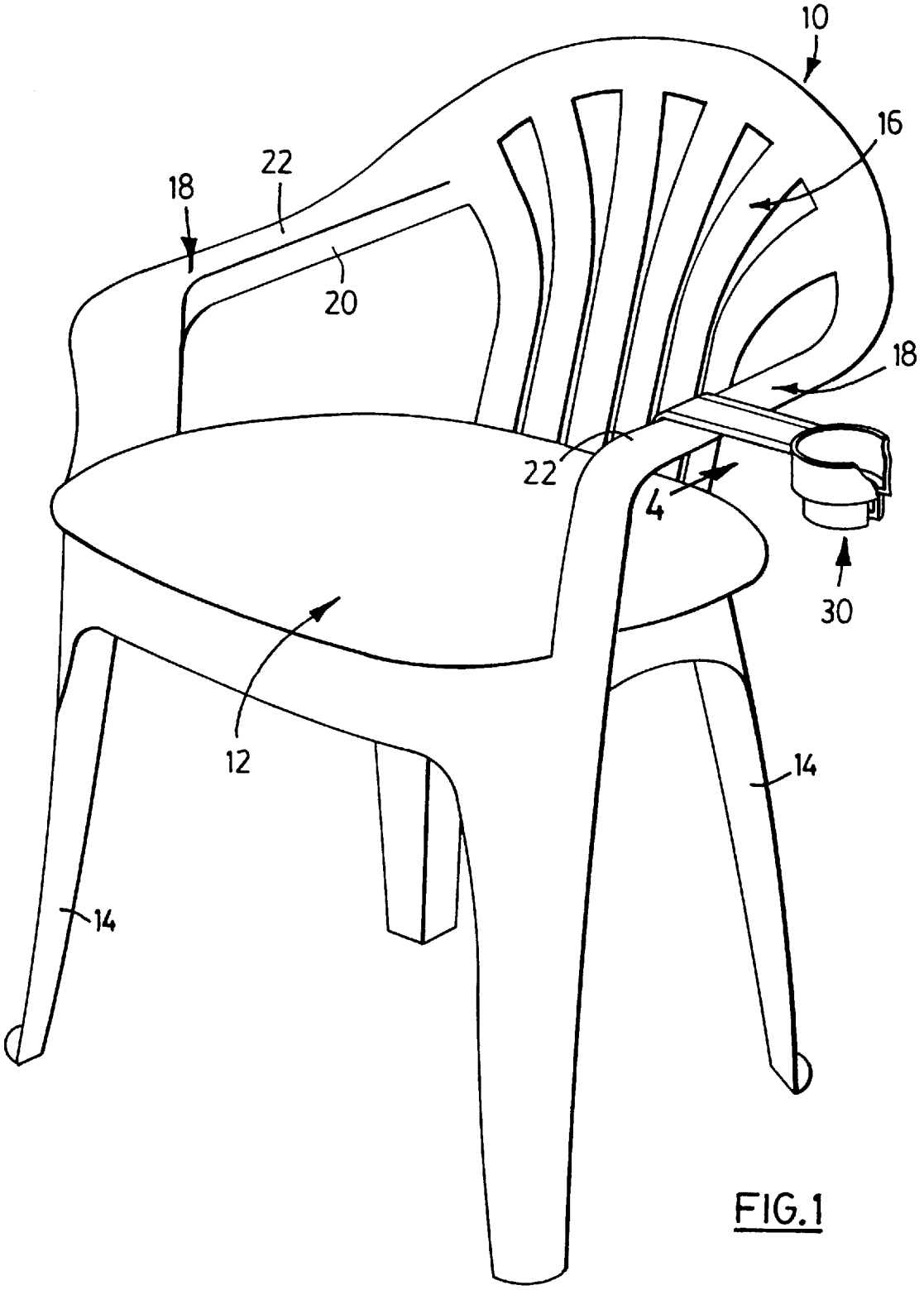
FIG. 1 is a perspective view of a patio chair having a beverage container holder in accordance with the present invention attached to an armrest thereof.
Figure 2:
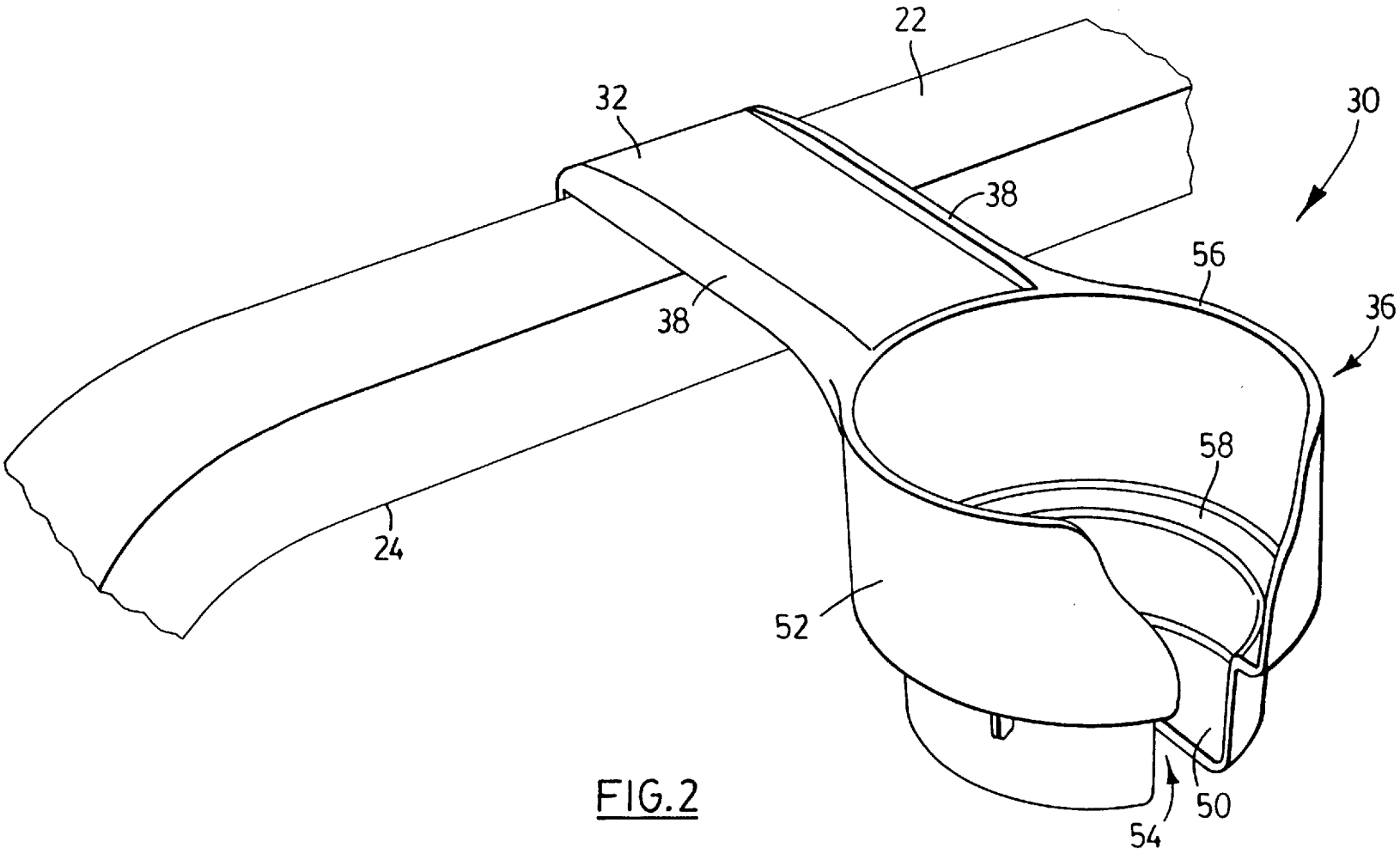
FIG. 2 is an enlarged perspective view of a portion of the armrest and the beverage container holder of FIG. 1.
Figure 3:
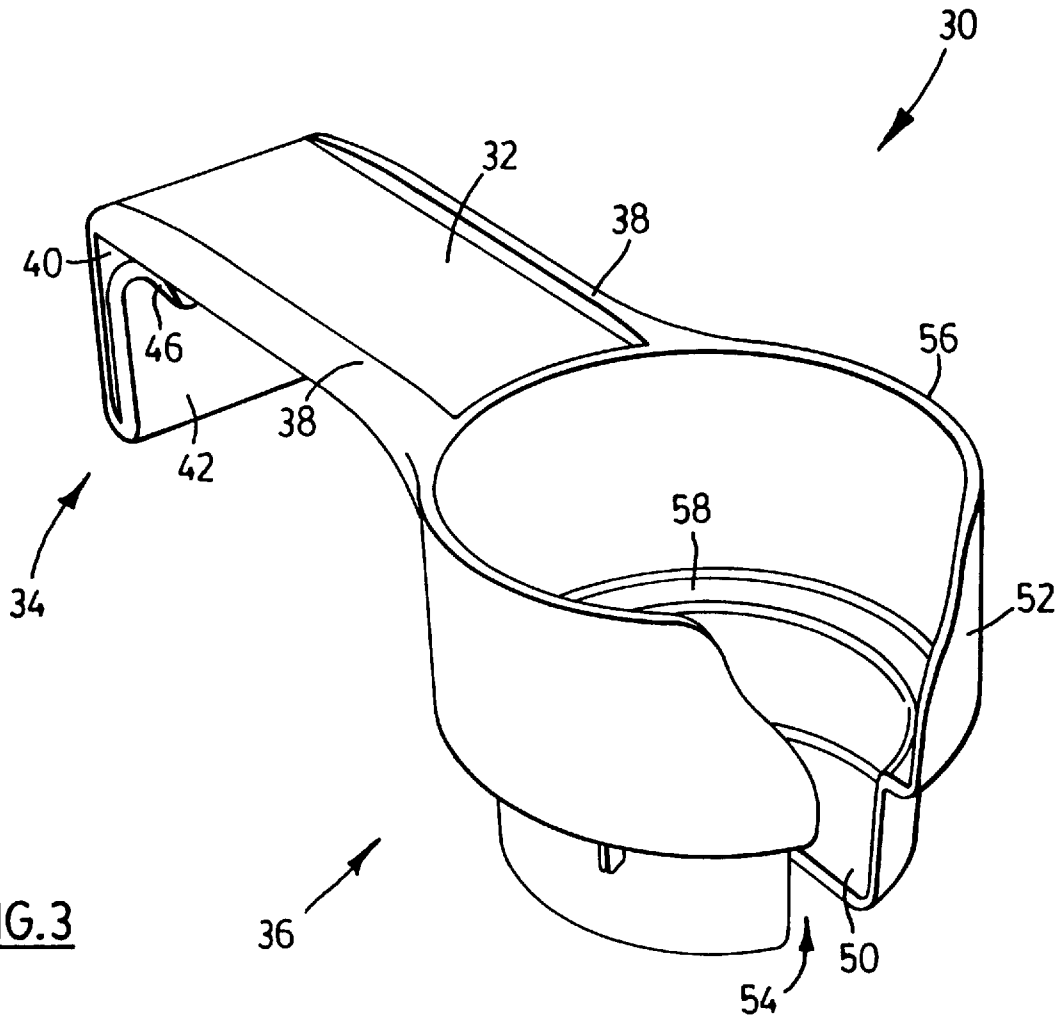
FIG. 3 is a perspective view of the beverage container holder illustrated in FIG. 2.

Referring now to FIGS. 1 and 2, a patio chair generally indicated to by reference numeral 10 is shown. Chair 10 includes a seat 12 supported above a ground surface by a plurality of legs 14. A backrest 16 integrally formed with the seat 12 extends upwardly from the rear edge of the seat 12. A pair of armrests 18 integrally formed with the backrest 16 extend forwardly from the backrest 16 above opposed side edges of the seat.

Each armrest 18 curves downwardly near the front of the chair 10 and terminates at a front corner of the seat 12. Each armrest is generally L-shaped in cross-section (see FIG. 4) and includes a generally vertical inner sidewall 20 and a generally horizontal top 22 integrally formed with and extending to one side of the sidewall 20. A depending lip 24 is provided along the outside edge of the top 22.

Removably connected to one of the armrests 18 and extending generally at a right angle to the armrest 18 is a beverage container holder 30 in accordance with the present invention. Beverage container holder 30 is designed to facilitate its attachment to and removal from the armrest 18 of the chair 10 and to allow a variety of different types of beverage containers to be supported in a stable manner. Details of the beverage container holder 30 will now be described with particular reference to FIGS. 2 to 5.

Turning now to FIGS. 2 to 5, the beverage container holder 30 is better illustrated. In this particular example, the beverage container holder 30 is of a one-piece construction formed of moulded polystyrene plastic. The beverage container holder 30 includes a generally planar, rectangular arm member 32 having a flexible retainer 34 at one end thereof to attach removably the beverage container holder 30 to the armrest 18. At the opposite end of the arm 32 is a beverage container receptacle 36 to receive and support a beverage container in a generally upright, stable condition when the beverage container holder 30 is attached to the armrest 18. Laterally spaced, longitudinally extending supporting ribs 38 are provided on the upper surface of the arm member 32. The supporting ribs 38 run adjacent opposed side edges of the arm member 32 to reinforce the arm member. The supporting ribs 38 decrease in thickness near the flexible retainer 34.

Figure 4:
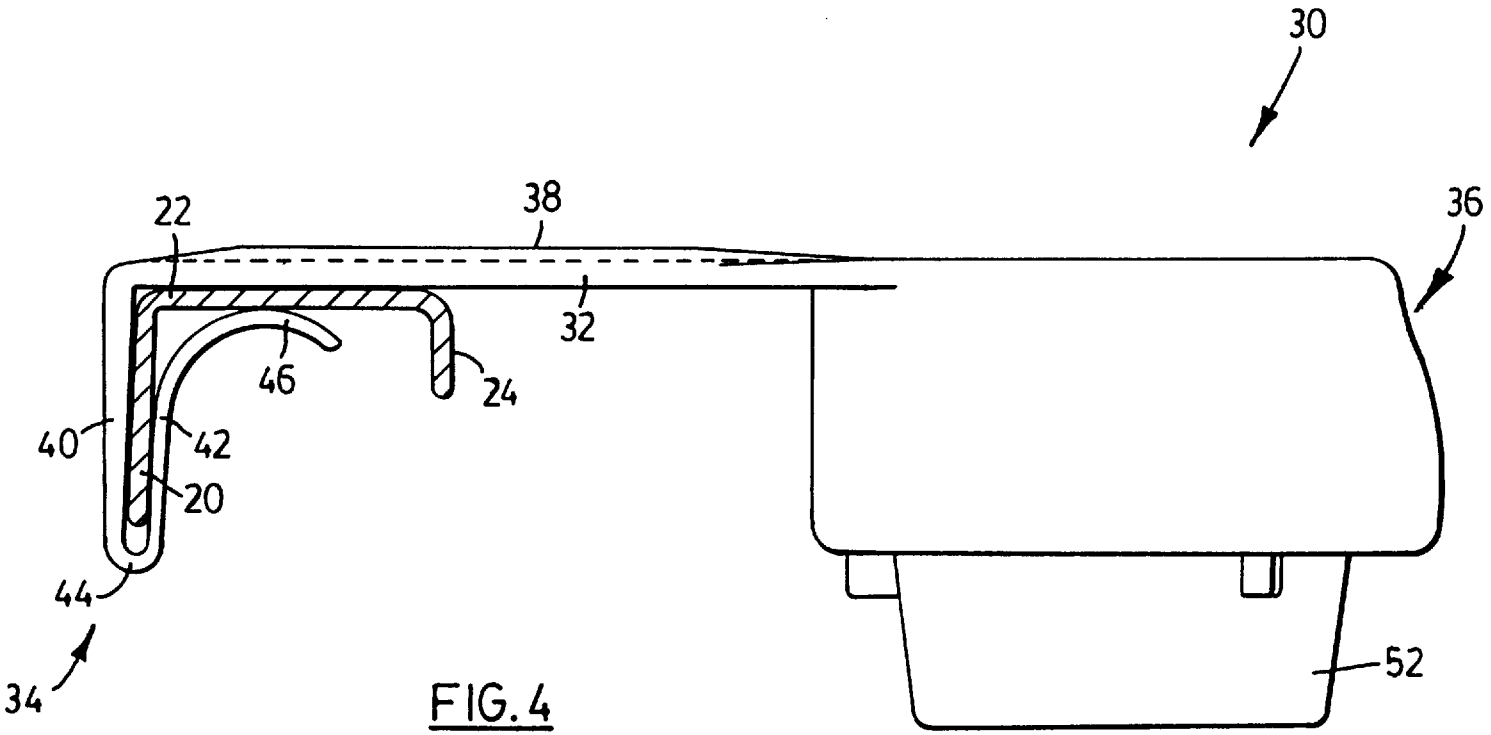
FIG. 4 is a cross-sectional view of FIG. 1 taken along line 4—4 showing the beverage container holder in side elevation.
Figure 5:
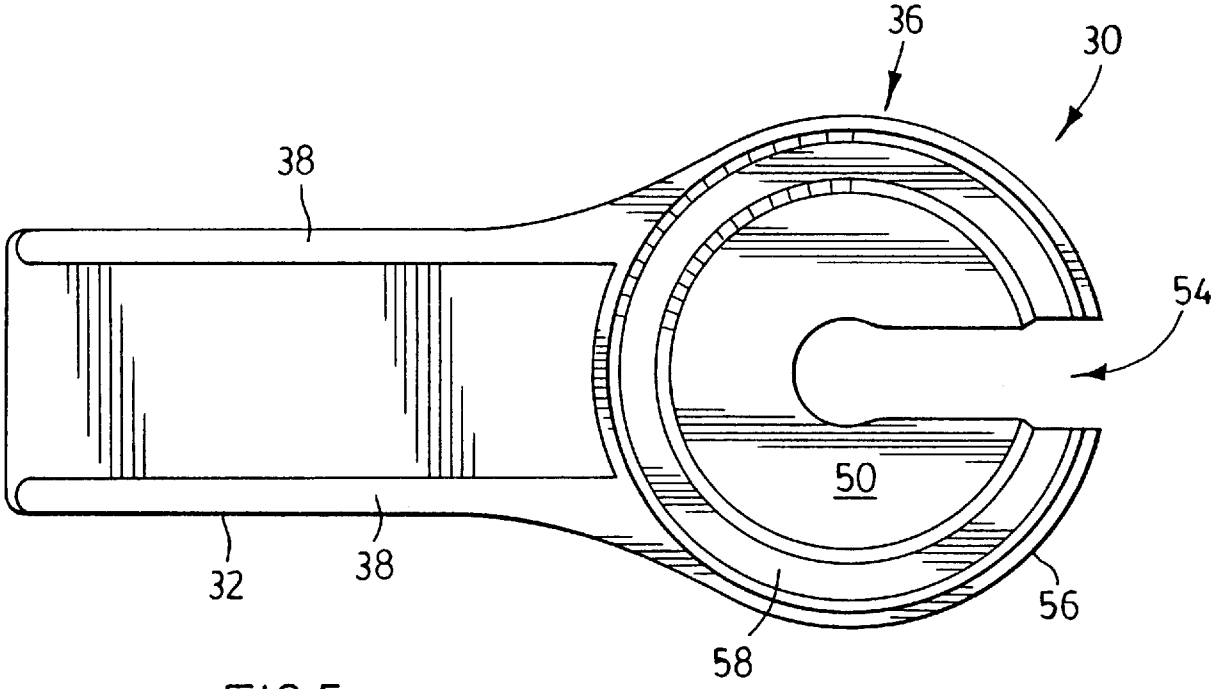
FIG. 5 is a top plan view of the beverage container holder illustrated in FIG. 1.

Flexible retainer 34 is generally U-shaped and includes a pair of arms 40 and 42 joined by a bight 44. Arm 40 depends from the end of arm member 32. Arm 42 has a free distal end 46 which is spaced slightly below the undersurface of the arm member 32. The distal end 46 is also outwardly flared. As can be seen in FIG. 4, when the beverage container holder 30 is attached to the armrest 18, the sidewall 20 of the arm rest is accommodated in the space between the arms 40 and 42. The outwardly flared distal end 46 of arm 42 contacts the undersurface of the top 22 of the armrest 18 to hold securely the beverage container holder 30 to the armrest.

The receptacle 36 includes a circular base 50 and an upright wall 52 extending generally about the periphery of the base. A slot 54 positioned diametrically opposite the arm member 32 extends through the upright wall 52 from the upper rim 56 of the upright wall to the base 50. The slot 54 also extends partially across the base 50 and terminates generally at its center. The slot 54 increases in width near the upper rim 56 and takes a generally circular configuration at the center of the base 30.

The upright wall 52 is stepped to define an annular support surface 58 within the receptacle 36 vertically spaced from and of a greater diameter than the base 50. The annular support surface 58 lies in a plane generally parallel to the base.

Figure 6A:
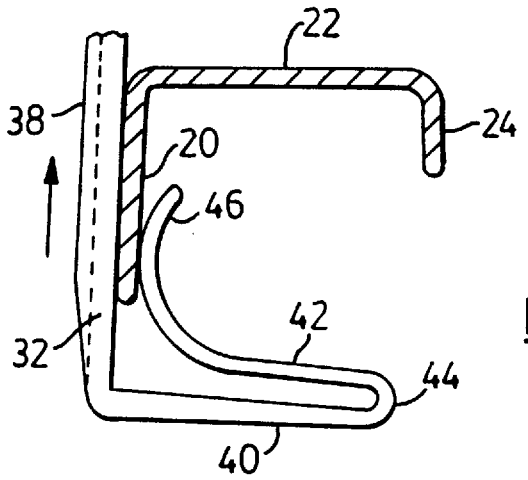
FIGS. 6*a* to 6*c* are side elevational views of a portion of the beverage container holder of FIG. 2 during attachment to the armrest.
Figure 6B:
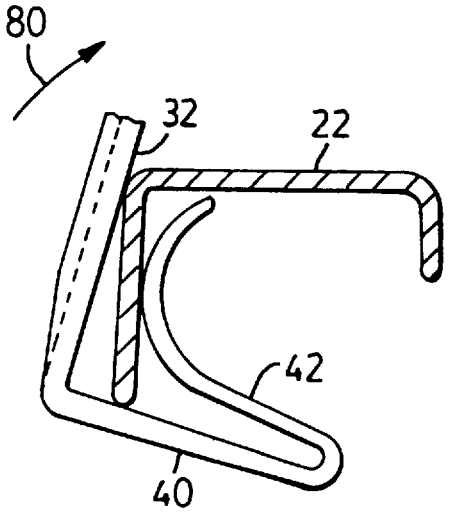
Figure 6C:
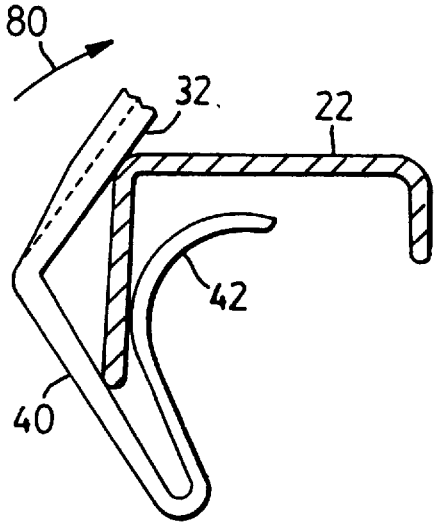
Figure 7:
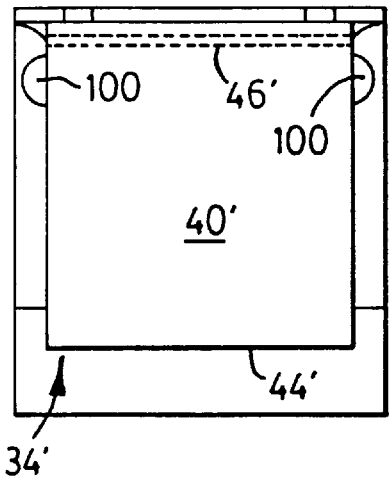
FIG. 7 is an end view of an alternative embodiment of a flexible retainer for the beverage container holder of FIG. 2.

When it is desired to attach the beverage container holder 30 to the armrest 18, the arm 42 is pulled away from the arm 40 causing arm 42 to flex about the bight 44. This is done until the distal end 46 of the arm 42 is spaced from the undersurface of the arm member 32 a sufficient distance to accommodate the inner sidewall 20. The beverage container holder 30 is then positioned to allow the inner sidewall 20 to extend the space between the undersurface of arm member 32 and the distal end 46 with the inner sidewall 20 contacting the arm 40 (see FIG. 6*a*). Once the inner sidewall 20 is positioned in the space and contacts the arm 40, the beverage container holder 30 is pivoted in the direction of arrow 80 (see FIGS. 6*b* and 6*c*) so that the inner sidewall 20 moves into the space between the arms 40 and 42. The beverage container holder 30 is pivoted until the arm member 32 overlies the top 22 and extends outwardly from the armrest 18 generally at a 90° angle to the armrest. The flared distal end 46 of the arm 42 contacts the undersurface of the top 22 to ensure a secure attachment of the beverage container holder 30 to the armrest.

Removing the beverage container holder 30 from the armrest 18 is just as simple an operation. It is only necessary to pivot the beverage container holder 30 upwardly away from the top 22 until the U-shaped flexible retainer 34 can be slid downwardly to remove the sidewall 20 from the space between the arms 40 and 42.

When the beverage container holder 30 is attached to the armrest 18 and it is desired to support a beverage container, the beverage container simply needs to be placed within the receptacle 36. Taller narrow containers are usually supported in a stable manner by the base 50. Shorter wider containers such as "highball" glasses are either supported in a stable manner on the base 50 or on the annular support surface 58 depending on the diameter of the container. In the case of beverage containers with handles such as "coffee mugs", unlike prior art beverage container holders, these beverage containers can also be supported in a stable manner within the receptacle 36 by orienting the beverage container so that the handle extends through the slot 54 in the upright wall 52. Similarly in the case of beverage containers with stems such as "wine glasses", these types of beverage containers can also be supported in a stable manner within the receptacle 36. This is done by inserting the beverage container into the receptacle 36 from the side with the stem passing through the slot 54 in the upright wall 52 and base 50 and extending below the base. The bowl of the beverage container is supported within the receptacle 36 either on the base 50 or on the annular support surface 58 depending on the diameter of the bowl.

As will be appreciated, the present invention provides a beverage container holder 10 which can easily support different types of beverage containers including those having stems or handles in a stable manner.

The beverage container holder 30 can be made having a receptacle of basically any desired size depending on the types of beverage containers to be supported therein. In a preferred embodiment, the receptacle 36 is approximately 2.8 inches deep, has an upper rim 56 with a diameter equal to approximately 3.5 inches and has a base 50 with a diameter equal to approximately 2.9 inches. The width of the slot 54 is selected to accommodate different lengths and thicknesses of glass stems and cup handles and in a preferred embodiment, is approximately 0.7 inches at its narrowest point.

It will be appreciated by those of skill in the art that the geometric shape of the beverage container holder may be altered provided the functionality of the beverage container holder is maintained. It will also be appreciated by those of skill in the art, that the beverage container holder 30 can be attached to the armrest of different types of chairs and that the patio chair 10 is shown for illustrative purposes only.

Although the receptacle 36 has been shown on a beverage container holder having a generally U-shaped retainer to attach the beverage container holder to the armrest of a chair, it should be apparent to those of skill in the art that the receptacle 36 may be used with other types of beverage container holders having different types of connectors to attach the beverage container holder to armrests or other types of supporting surfaces. These different types of connectors can for example include clamps or fasteners such as screws or nuts and bolts.

Although the slot is shown diametrically opposite the arm member 32, it should be appreciated that the position of the slot can be altered if desired. Also, although the slot is shown extending from the upper rim of the upright wall to the base and partially across the base, the length of the slot can be changed if desired. For example, if supporting glasses with stems is not a concern, the slot need only extend downwardly through the upright wall from the upper rim.

Referring now to 7, an alternative embodiment of a flexible retainer 34' for the beverage container holder is shown. In this embodiment, tabs 100 are provided on the arm near its free distal end 46'. The tabs 100 facilitate pivoting of the arm about the bight 44' to space the distal end 46' from the undersurface of the arm member 132 a sufficient distance to accommodate the sidewall of the arm rest.

Figure 8:
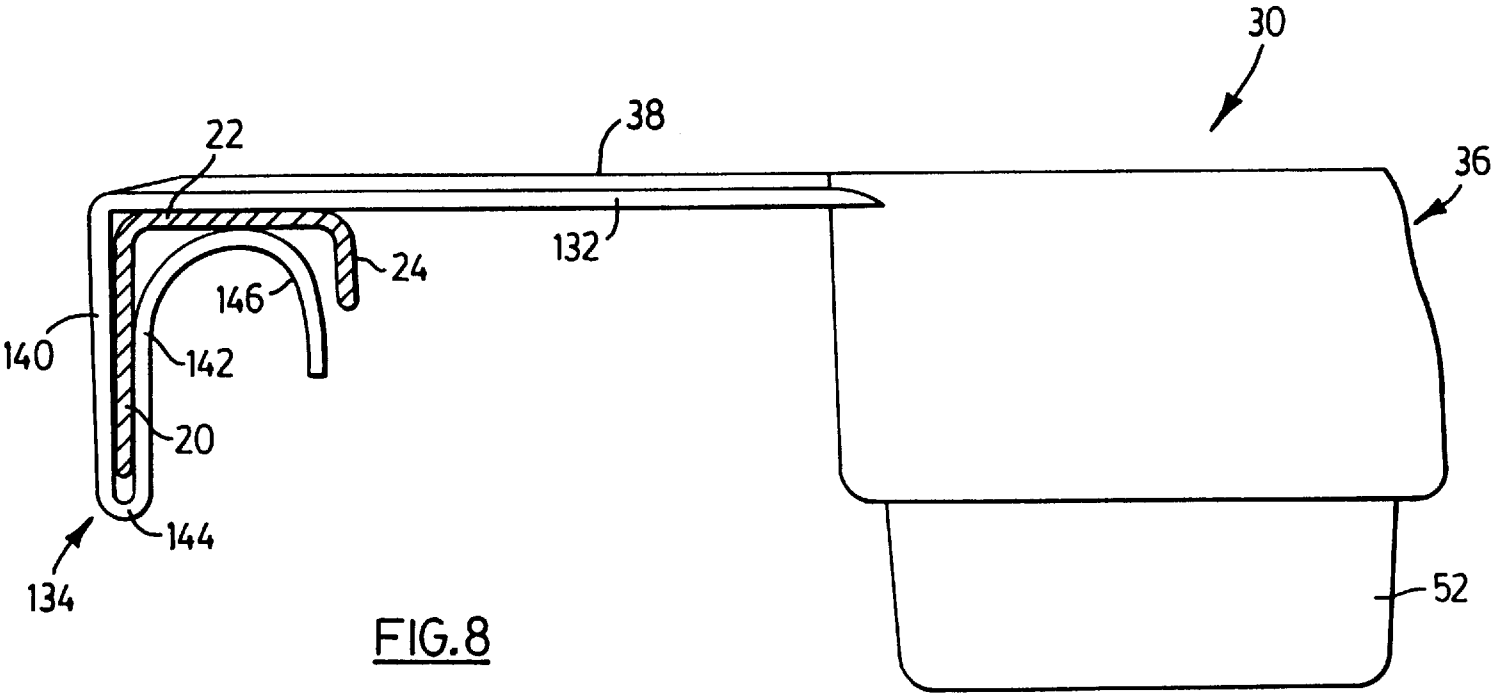
FIG. 8 is a side elevation view of another alternative embodiment of a flexible retainer for the beverage container holder of FIG. 2.

FIG. 8 shows yet another embodiment of a flexible retainer 134 for the beverage container holder designed to facilitate pivoting of the arm 142 about the bight 144. In this case, the free distal end 146 of the arm is extended and curves back away from the undersurface of the arm member 132. Pressure can be applied to the free distal end 146 to flex the arm 142 about the bight 144 and open up the space between the arm 142 and the arm member 132.

Figure 9:
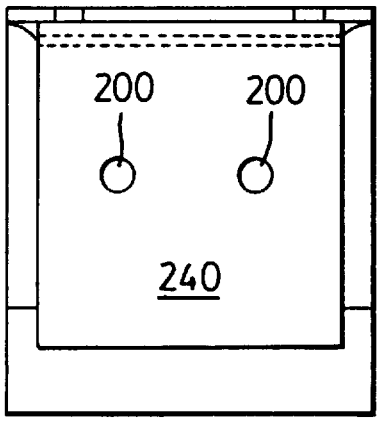
FIG. 9 is an end view of yet another alternative embodiment of a flexible retainer for the beverage container holder of FIG. 2.

FIG. 9 shows still yet another embodiment of the flexible retainer. In this embodiment, a pair of laterally spaced holes 200 are provided in the arm 240 to accommodate fasteners in cases where a user wishes to fasten the beverage container holder to the armrest of a chair or other support structure. In this case, the other arm and bight of the flexible retainer would be removed from the arm 240 allowing the arm to sit flush against the surface to which the fasteners are to pass.

Figure 10:
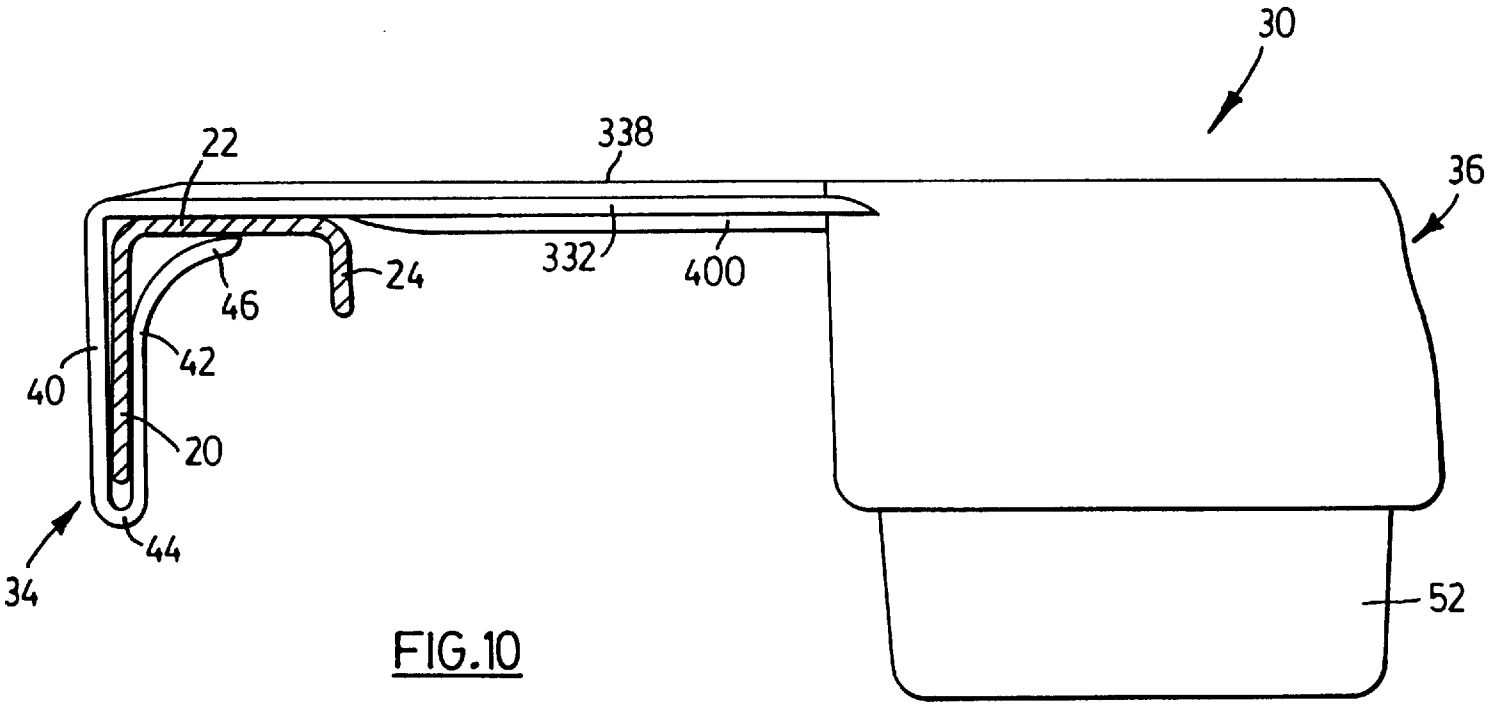
FIG. 10 is a side elevational view of still yet another embodiment of a beverage container holder in accordance with the present invention.
Figure 11:
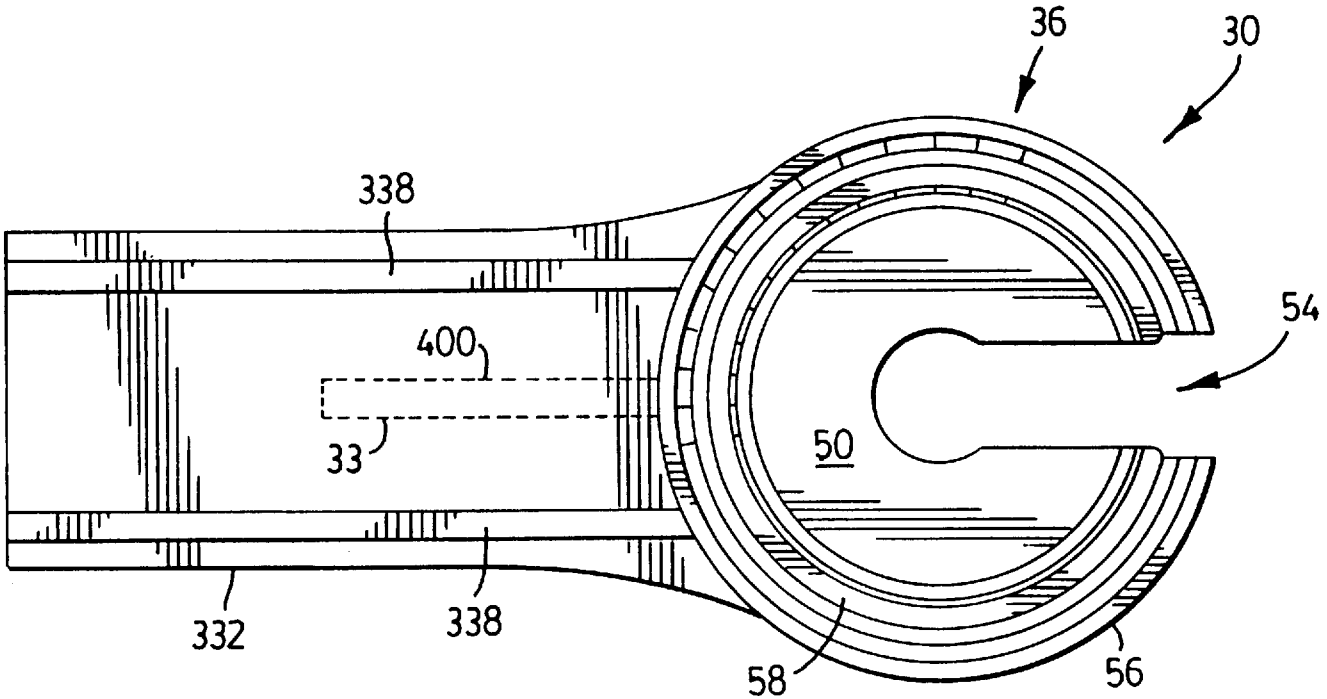
FIG. 11 is a top plan view of the beverage container holder of FIG. 10.

FIGS. 10 and 11 show an alternative embodiment of the arm member 332 for the beverage container holder. In this embodiment, an additional supporting rib 400 is provided on the undersurface of arm member. The supporting rib 400 extends along the central longitudinal axis of the arm member 332 and partially along its length so as not to interfere with the top of the armrest to which the beverage container holder is attached.

While preferred embodiments of the present invention have been described, those of skill in the art will appreciate that variations and modifications may be made thereto without departing from the spirit and scope of the present invention as defined by the claims appended.

I claim:

1. A beverage container holder to be removably attached to an armrest of a chair, said armrest having a generally vertical sidewall and a generally horizontal top extending from said sidewall, said holder being formed of a unitary piece of material and comprising:

an arm member to overlie said armrest top and extend generally at a right angle a length of to said armrest;

a receptacle at one end of said arm member to receive and support a beverage container; and a generally U-shaped flexible retainer at an opposite end of said arm member, said flexible retainer including a pair of arms joined by a bight, one of said arms depending from said arm member, the other of said arms being positioned beneath said arm member and being free of said arm member, said arms being moveable relative to one another to accommodate said sidewall when said sidewall is inserted between said other arm and an undersurface of said arm member and said arm member is pivoted to overlie the armrest top thereby to position said sidewall between said arms and attach said beverage container holder to said armrest.

2. A beverage container holder as defined in claim 1 wherein said receptacle includes a base and at least one upright wall extending generally about the periphery of said base.

3. A beverage container holder as defined in claim 2 further including a slot formed in said upright wall and extending downwardly from an upper rim thereof.

4. A beverage container holder as defined in claim 3 wherein said slot extends downwardly to said base and partially across said base.

5. A beverage container holder as defined in claim 4 wherein said base is circular and said at least one upright wall is generally cylindrical, said slot terminating adjacent the center of said base.

6. A beverage container holder as defined in claim 5 wherein said receptacle further includes an annular support surface therein spaced from said base, said annular support surface lying in a plane generally parallel to said base.

7. A beverage container holder as defined in claim 6 wherein said upright wall is stepped to define said annular support surface.

8. A beverage container holder as defined in claim 4 wherein said slot increases in width adjacent said upper rim.

9. A beverage container holder as defined in claim 1 wherein said other arm includes a free distal end which curves downwardly away from an undersurface of said arm member.

10. A beverage container holder as defined in claim 1 wherein said other arm has a free distal end positioned adjacent said arm member.

11. A beverage container holder as defined in claim 10 wherein said free distal end is outwardly flared.

12. A beverage container holder as defined in claim 11 wherein said free distal end is spaced from an undersurface of said arm member and contacts an undersurface of said armrest top when said beverage container holder is attached to said armrest.

13. A beverage container holder as defined in claim 10 wherein said arm member has at least one longitudinally extending supporting rib thereon.

14. A beverage container holder as defined in claim 13 wherein said arm member has a pair of said laterally spaced, longitudinally extending supporting ribs on an upper surface thereof.

15. A beverage container holder as defined in claim 14 wherein said supporting ribs are integrally formed with said arm member and run adjacent opposed side edges of said arm member.

16. A beverage container holder as defined in claim 15 further including an additional supporting rib on an undersurface of said arm member.

17. A beverage container holder as defined in claim 10 further including at least one outwardly extending tab on said other arm.

* * * * *